US005463358A

United States Patent [19]

Dunn et al.

[11] Patent Number: 5,463,358

[45] Date of Patent: Oct. 31, 1995

[54] MULTIPLE CHANNEL MICROWAVE ROTARY POLARIZER

[76] Inventors: Daniel S. Dunn, 10612 Abingdon Chase, Orlando, Fla. 32817; Eugene P. Augustin, 2713 Lemon Tree La., Orlando, Fla. 32809

[21] Appl. No.: 124,015

[22] Filed: Sep. 21, 1993

[51] Int. Cl.[6] ..... H01Q 13/02; H01P 5/12

[52] U.S. Cl. ..... 333/1; 333/21 A; 343/756; 343/786

[58] Field of Search ..... 333/126, 135, 333/21 A, 1; 343/756, 786

[56] References Cited

U.S. PATENT DOCUMENTS

| | | | |
|---|---|---|---|
| 2,880,399 | 3/1959 | Murphy | 333/21 A X |
| 4,071,833 | 1/1978 | Gould | 333/33 |
| 4,414,516 | 11/1983 | Howard | 333/21 A |
| 4,528,528 | 7/1985 | Augustin | 333/21 A |
| 4,740,795 | 4/1988 | Seavey | 343/786 |
| 4,821,046 | 4/1989 | Wilkes | 343/786 |
| 4,841,261 | 6/1989 | Augustin | 333/21 A |
| 4,862,187 | 8/1989 | Hom | 343/786 |
| 4,872,211 | 10/1989 | Chen | 343/778 |
| 4,903,037 | 2/1990 | Mitchell et al. | 343/756 |
| 5,066,958 | 11/1991 | Blachley | 343/756 |
| 5,103,237 | 4/1992 | Weber | 333/126 X |
| 5,107,274 | 4/1992 | Mitchell et al. | 343/756 |

*Primary Examiner*—Paul Gensler

[57] ABSTRACT

This invention is a multiple channel microwave polarization rotator with external rotary mechanical energy coupling. It finds application in microwave polarization rotators, resolvers, amplitude modulators, and other devices. The device consists of a plurality of collinear axially spaced waveguide cavities sequentially located inside one another. A rotatable conductor, capable of continuous rotation, located within each waveguide cavity is electrically coupled to a stationary transmission line and mechanically connected to rotational devices outside of the transmission line system. The rotatable conductors are connected by nonconductive drive means enabling successive coupling probes to rotate determining the polarization of electromagnetic waves by the rotational position of the coupling probes within the waveguides. The electrical and mechanical couplings are completely independent.

10 Claims, 4 Drawing Sheets

MULTIPLE CHANNEL MICROWAVE ROTARY POLARIZER

BACKGROUND—FILED OF INVENTION

This invention relates to transmission line coupling devices for high frequency transmission lines, such as used for microwaves. Particularly, the invention relates to rotatable transmission line couplings in which multiple rotatable transmission line members are mechanically coupled to the outside of the transmission line system for performing a variety of functions and the multiple transmission lines are capable of operating over distinct frequency bands while simultaneously rotating the orientation of the polarization of each transmission line coupling in each of its respective waveguide. A typical application is that of a waveguide coupling which rotates the plane of polarization of the waves transmitted through the device by external rotary energy source means.

BACKGROUND—DESCRIPTION OF PRIOR ART

Many different arrangements have been used to mechanically rotate the plane of polarization of a single channel of a transmitted high frequency wave. For example, the amplitude modulator disclosed in the patent to Murphy U.S. Pat. No. 2,880,399, and the rotary polarization couplings disclosed in the patents to Augustin U.S. Pat. Nos. 4,528,528, and 4,841,261, and many patents divulging differing linear polarization coupling probe shapes in the cylindrical waveguide of devices patented after Augustin. However, all of these devices have been single channel devices. Most have been designed for the C-Band reception of satellite TVRO signals. All of these devices have the common feature that the port whose polarization is rotated is a port having rotational symmetry, generally cylindrical. All of these devices have the rotatable coupling located on the longitudinal axis of the cylindrical waveguide. With the increase in communication satellites worldwide, it is now desirable for a single antenna to be able to simultaneously transmit or receive multiple signals without interference between the signals and also have the capability to rotate the plane of polarization of these signals. For instance, simultaneous C-Band and Ku-Band reception is required for certain TVRO applications, and simultaneous L-Band, C-Band, and Ku-Band reception is desirable in certain applications.

Considering the rotation of polarization requirement, two classes of devices have been used for dual band operation. These are coaxial devices (in the concentric sense and not necessarily a generic transmission line type), and offset devices. The offset devices are trivial solutions to the problem in that they merely have a high frequency device closely spaced to a low frequency device, and the devices are effectively independent of one another. When used as a feed for an antenna, there is a large boresight shift between the two feeds that results from the offset. Therefore, they can not be used for simultaneous operation on the same satellite. These devices are not relevant to this present invention.

Coaxial dual channel devices generally have a higher frequency band device contained concentrically completely within a lower frequency band device. A mechanical coupling moves the higher frequency polarization changer synchronously with the lower frequency device. All of these prior devices utilize the fundamental teachings of Augustin U.S. Pat. 4,528,528 for the low frequency polarization change mechanism.

Prior approaches to coaxial dual frequency feed assemblies are illustrated in the following U.S. patents:

| U.S. Pat. No. | Inventor | Issued |
|---|---|---|
| 4,740,795 | John M. Seavey | April 26, 1988 |
| 5,107,274 | Rodney A. Mitchell<br>Gerry B. Blachley | April 21, 1992 |

All of the previous coaxial dual frequency polarization type devices are limited to only two channels due to the employed method of electrical and mechanical coupling means.

All of the previous coaxial dual frequency polarization type devices require the low frequency transmission line to be orthogonal to the backwall of the device restricting the orientation of the rectangular waveguide with respect to the cylindrical waveguide.

All of the previous coaxial dual frequency polarization type devices require a ninety degree waveguide bend to allow electromagnetic wave propagation in the same direction as the cylindrical waveguide for at least the low frequency input/output.

None of the previous devices lend themselves to direct coupling to coaxial transmission lines or other transmission line forms on all bands without an intervening rectangular waveguide type transmission line on at least one of the channels.

None of the previous devices lend themselves to direct coupling to coaxial transmission lines or other transmission line forms on some or all bands through a non-contacting type of transmission coupling.

None of the previous devices allow unlimited and continuous rotation of the energy coupling for all channels.

OBJECTS AND ADVANTAGES

Accordingly, I claim the following as my objects and advantages of the invention: to provide a multiple channel microwave rotary polarizer capable of driving or being driven by external means, and functioning as ordinary transmission line elements in so far as connection of each channel to other devices, or for the purpose of impedance matching of the device, while serving as multiple independent polarization coupling channels within the same structure having separate input ports concentrically located inside the other and multiple separate output ports. Of course, the terms input and output may be reversed on each individual channel since the device is reciprocal. All channels may be simultaneously rotated continuously without limit.

In the simplest embodiment, the invention has two channels. For simplicity, the invention will be described as a two channel device. However, the fundamental teaching may readily be extended to multiple channels.

It is a general object of this invention to provide an improved rotary coupling for use in transmission line systems requiring multiple outputs from separate inputs within the same structure, and particularly in microwave transmission. A feature of this invention is to provide a rotary coupling in which the coupled members for each channel can be freely rotated without affecting the transmission characteristics of the transmission line for any of the multiple channels, and these rotatable members have external mechanical rotational connection means. This free rotation and mechanical coupling without affecting the junctions microwave transmission characteristics can be used to precisely drive the coupled lines from external means, or it can be used to precisely sense the rotational position of the coupled lines through external means, or both of these functions simultaneously. These functions may be achieved in a simple and compact unit.

Another feature of this invention is that it is smaller, lighter weight, has fewer parts and is less expensive to manufacture than presently used devices.

It is another feature of this invention to provide mechanical rotation paths that are different from the microwave signal paths.

A still further feature of this invention is that the coupled lines may have their longitudinal axes intersecting at virtually any angle.

A still further feature of this invention is to provide a microwave transmission line rotator with multiple channels which are readily controlled by external means.

A still further feature of this invention is to provide a microwave transmission line rotator which is readily capable of coupling positional information from multiple channels to external devices.

A still further feature of this invention is to provide transmission line rotary couplings which are impedance matched for all orientations of linear polarization over a wide band of frequencies, and wherein the frequency band for each channel is independent of that for the other channel.

A still further feature of this invention is to provide lossless coupling between the transmission line segments.

A still further feature of this invention is to provide multiple transmission line rotary couplings with external rotary mechanical coupling means, independent of the electrical coupling means.

A still further feature of this invention is to provide multiple transmission line rotary coupling elements which are compact and self contained and have the ability to be readily adjusted for a specific rotary orientation.

A still further feature of this invention is the ability to provide unlimited continuous rotation of polarization.

A still further feature of this invention is to provide a transmission line rotary coupling assembly in which the microwave coupling is independent of the input devices, or the output devices, or the mechanical devices attached to it to determine and/or control its specific rotary orientations.

A still further feature of this invention is to provide mechanical coupling without affecting the electrical coupling.

A still further feature of this invention is to provide a rotary junction as explained in the patents to Augustin U.S. Pat. Nos. 4,528,528 and 4,841,261 for some or all of the multiple channels.

For polarization type coupling, this present device neither requires the common input section and the independent output section axes to be orthogonal. For the case of a waveguide polarization rotator this allows greater flexibility in the orientation of the rectangular waveguides with respect to the cylindrical waveguide, and eliminates ninety degree bends in the rectangular waveguides to allow propagation in the same direction as or in a direction orthogonal to the direction of the cylindrical waveguide for each channel.

The drive by external means may precisely select any linear polarization in the cylindrical waveguides and couple it to the transmission lines of multiple independent channels.

A further feature of this invention is that it allows polarization rotation of the signal for multiple independent channels within the same structure.

A further feature is that the polarization of the multiple channels may be changed synchronously with respect to one another with a single external drive means.

A further feature is that the selected polarization signal may be coupled into a coaxial transmission line, microstrip line, connector, or signal conditioning device without the need for waveguide on any channel. The multiple channel transmission line rotary junction with external mechanical coupling is the subject of the invention, and not the coupling probe configuration used in the cylindrical waveguide to achieve a desired polarization. Indeed, many shaped probes in the cylindrical waveguide including those of Murphy, Augustin, Gould, Howard and a myriad of other unreported shapes have provided satisfactory operation, using on the end opposite the cylindrical waveguide either a coaxial transmission line or a rectangular waveguide, or both.

In the description, the term cylindrical waveguide includes all classes of rotationally symmetric waveguides, such as cylindrical, square, or many sided but possessing longitudinal symmetry suitable for orthogonal mode propagation. The cylindrical waveguide back wall or conducting partition means, referred to as a fiat wall also includes all symmetric walls such as lune, hemisphere, ogive,elliptical, parabolic, etc.

All perturbational combinations of choke and contacting couplings are not shown in the above embodiments.

DESCRIPTION OF THE INVENTION

Figure 1:
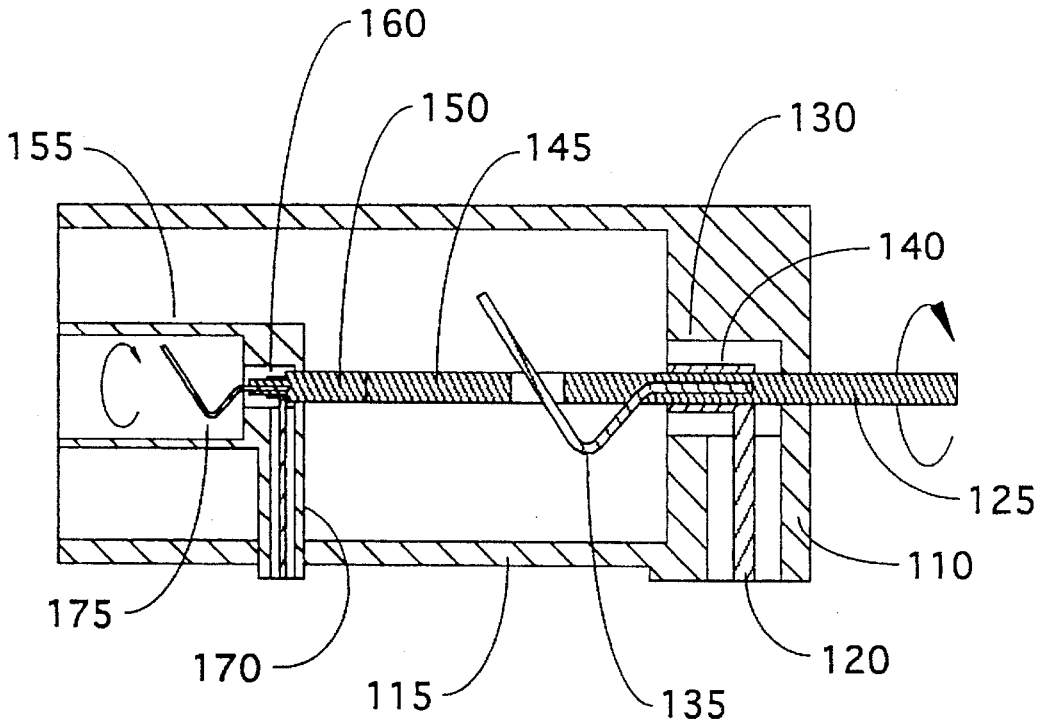
FIG. 1 is a cut away view of the invention having two independent channels utilizing choke couplings.

Referring to FIG. 1, a preferred embodiment of the invention includes a circular tube acting in the manner of a coaxial transmission line junction outer conductor having a first section 110 and a second section 130. Within this outer conductor and mounted concentrically to it is a two legged center conductor 120, 140 having a first leg 120 concentric with the first section 110 of the outer conductor and the second leg 140 concentric with the second section 130 of the outer conductor. The second leg 140 of the center conductor is comprised of a hollow cylinder. This hollow center conductor 140 has both ends open. Disposed within the hollow center conductor is a hollow dielectric support rod and drive 125 having a portion contained within the hollow center conductor. Contained within this hollow dielectric support rod 125 is the end portion of a center conductor transmission line 135. The overlapping of the center conductor transmission line 135 and the second leg of the hollow center conductor 140 is approximately one quarter wavelength long at the mid-band frequency of the desired frequency band of operation. The center conductor transmission line transforms the electromagnetic energy from a coaxial TEM mode of propagation into a circular waveguide TEll mode. The circular waveguide outer conducting wall 115 is dimensioned such that it is capable of propagating the desired frequency band. The electromagnetic energy is then transformed to a coaxial waveguide mode of propagation by the outer conducting wall of the cylindrical waveguide 115 and the inner conducting wall 155. The dielectric support rod is free to rotate within the hollow center conductor 140. Rotation of the dielectric support rod causes the end portion of the transmission line center conductor 135 to rotate in kind. Thus, the transmission line center conductor can be precisely driven to any rotational angle by external means. The transmission line segment 125, 135, 140 forms a noncontacting capacitive choke coupling between two sections of the transmission line. The design of the choke section is described in the patent to Augustin U.S. Pat. No. 4,841,261.

Attached to the dielectric support rod 125 is the first end of a dielectric drive mechanism 145. The dielectric drive mechanism is the mechanical coupling means between the first and the second channel. The second end of the dielectric drive mechanism is engaged to the dielectric support rod 150 of the second channel. The second channel is shown as having identical features as the first channel except for smaller dimensions, thus operating at a higher frequency and electrically independent of the first channel. The dielectric support rod 150 passes through the coaxial outer conductor 170 and is contained within the hollow center conductor segment 160 of a two legged center conductor transmission line. Contained within this hollow dielectric support rod 150 is the end portion of a second center conductor transmission line 175. This second transmission line center conductor transforms a coaxial TEM mode of propagation to a TEll mode of propagation in the circular waveguide cavity 155.

Figure 2:
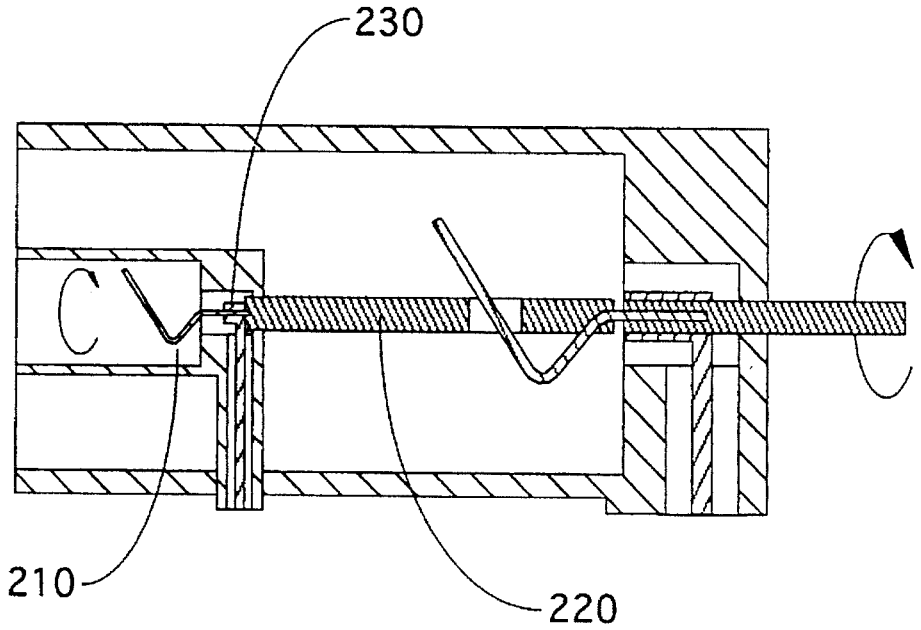
FIG. 2 is a cut away view of the invention utilizing a contacting junction for the second channel.

FIG. 2 is a cut away drawing of the invention in an alternate embodiment wherein the junction between the stationary leg 230 and the driven leg 210 of the second channel is a contacting junction as opposed to a choke junction. The driven leg of the second channel is mechanically coupled to the first channel by a dielectric drive rod 220 wherein the drive rod is driven by the first probe.

Figure 3:
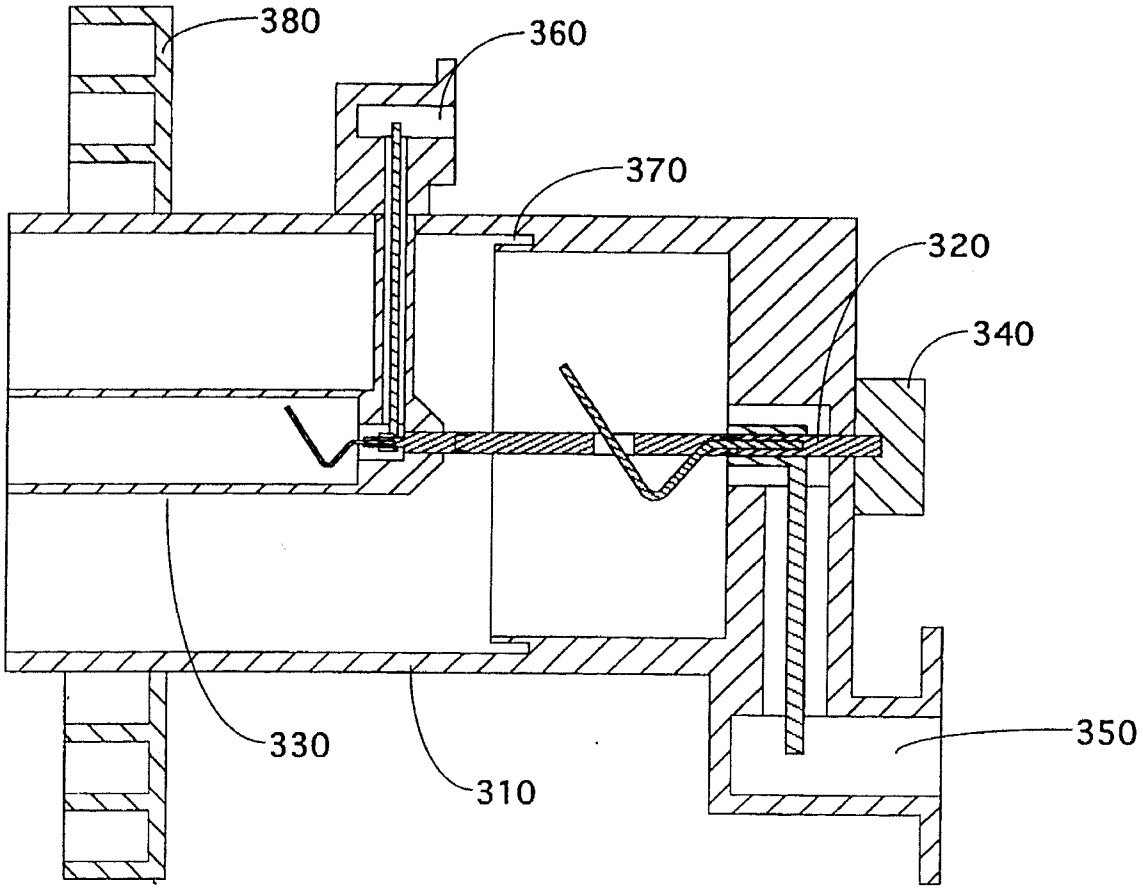
FIG. 3 is a cut away view of a preferred embodiment of the device as a dual microwave polarization rotator having two independent channels and with rectangular waveguide outputs.

FIG. 3 depicts a preferred embodiment of the invention in the form of a microwave polarization rotator radiating horn having two channels that could be used as a feed horn for a reflector antenna. The drive rod 320 is coupled to an accurate positioning device 340, such as a servo-drive motor. The polarization of the first and subsequent channels may be readily selected by the external drive. The fixed polarization end of each channel is terminated in rectangular waveguides 350, 360. The orientation of the rectangular waveguides shown in the figure is in line with the circular waveguides 310, 330, however, it could be any attitude. Either rectangular waveguide could be considered the input or output since the device is reciprocal. For example, in a transmit-receive application, one rectangular waveguide 360 could be used to transmit a signal out of the cylindrical port 330, while a signal received by the cylindrical tube 310 could be received by the other port 350. Located on the inner wall of the cylindrical tube 310 between the first and second channels is an optional one-quarter wavelength coaxial choke 370 that may aid in the impedance matching of the device. The radiating end of the smaller cylindrical waveguide may be aligned with respect to the radiating end of the larger cylindrical waveguide such that their radiating phase centers are coincident. The radiating aperture of the cylindrical tube is surrounded by an adjustable radial corrugated surface wave transmission line 380 to equalize the radiation characteristics of the cylindrical waveguide.

Figure 4:
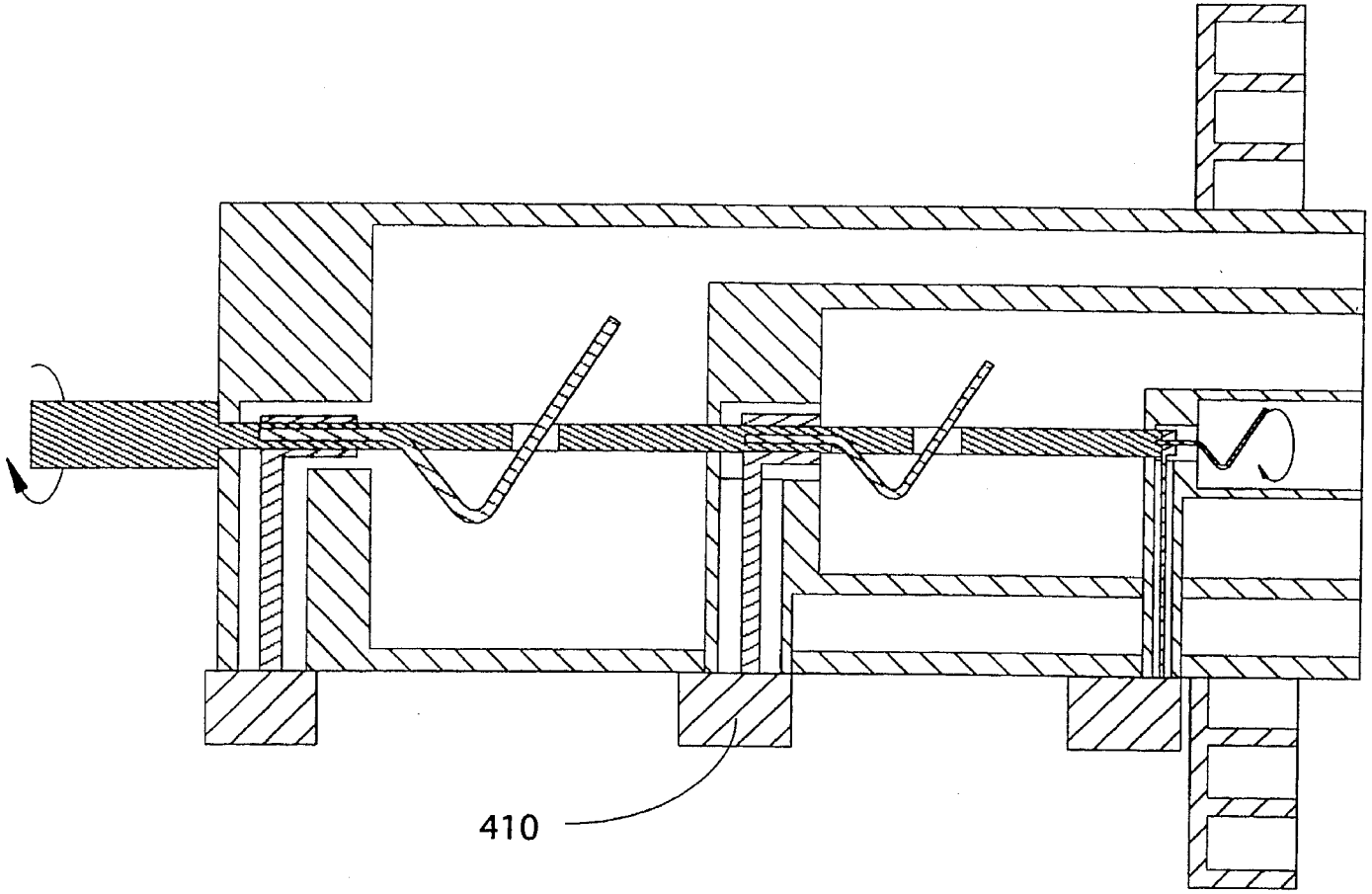
FIG. 4 is a cut away view of an embodiment of the invention employing three channels, each channels transmission lines are independent of each other and are coupled to signal conditioning devices.

FIG. 4 is another embodiment of the invention wherein the device employs three independent channels. The polarization of the first and subsequent channels is controlled through external drive means. Each of the channels' fixed polarization transmission lines are terminated in signal conditioning devices 410.

Figure 5:
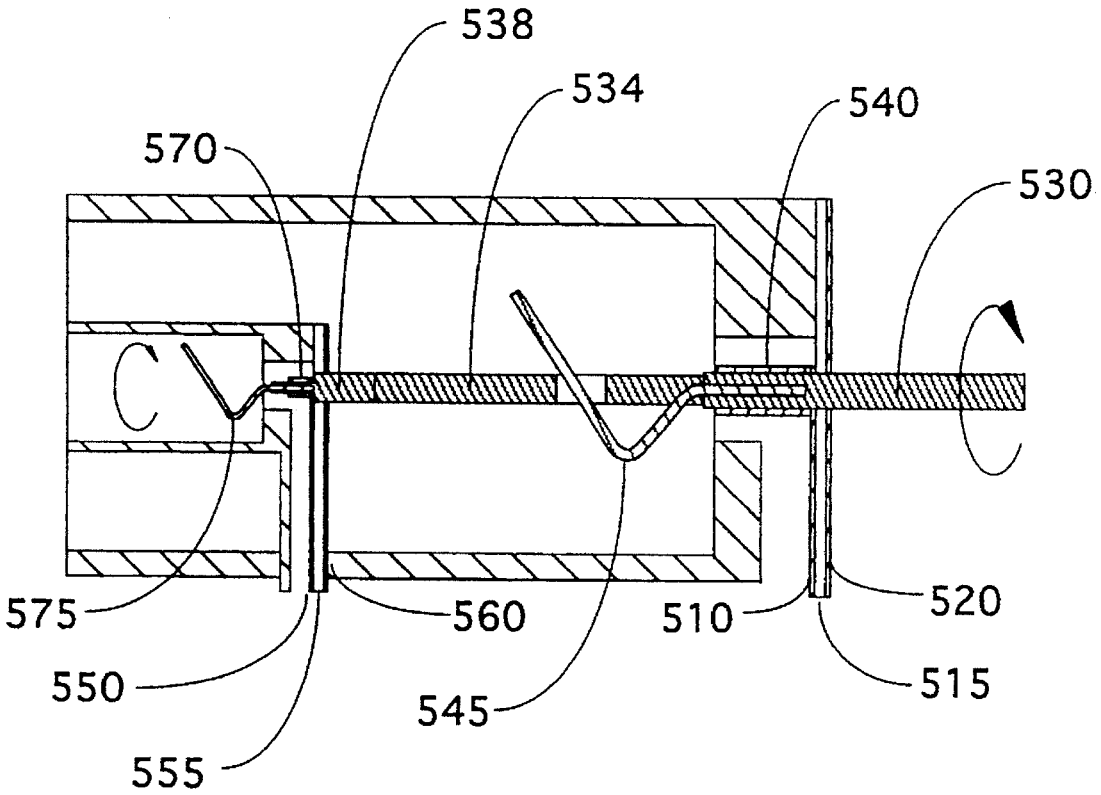
FIG. 5 is a cut away view of an embodiment of the invention employing microstrip lines as the coupling mechanism.

FIG. 5 is another embodiment of the invention wherein the transmission line types are microstrip segment and a coaxial line segment. Referring to FIG. 5, the microstrip section for the first channel comprises a ground plane 520 and a strip conductor 510 separated by a dielectric 515. The strip conductor has a hollow circular metal tube 540 affixed to it in the manner of a coaxial transmission line outer conductor. A dielectric support rod 530 is contained within the hollow metal tube 540 and is free to rotate within said outer conductor. Contained within the dielectric support rod is the end portion of a center conductor transmission line 545. Rotation of the dielectric support rod causes the center conductor transmission line to rotate in kind. Attached to the dielectric support rod is a dielectric drive mechanism 534 which couples the first and second channels. The second channel is shown as having identical features as the first channel except for smaller dimensions, thus operating at a higher frequency and electrically independent of the first channel. The dielectric drive mechanism is coupled to the dielectric support rod 538 which passes through the microstrip ground plane 560 and dielectric 555 and into a hollow metal tube 570. The hollow metal tube is affixed to the strip conductor 550 in the manner an outer conductor of a coaxial transmission line. Contained within the dielectric support rod is the end portion of a center conductor transmission line 575. Rotation of the first channels dielectric support rod 530 causes the first and second channels's center conductor transmission lines 545, 575 to rotate in kind.

We claim:

1. A multiple channel microwave rotary polarizer comprising a plurality of axially spaced collinear waveguides placed one inside the other, said waveguides each containing a continuously rotatable coupling probe capable of propagating electromagnetic energy in any orientation and located in close proximity to a conducting partition means of a respective one of said waveguides, first ends of each of said coupling probes being located within a respective one of said waveguides and second ends of each of said coupling probes passing through a respective one of said conducting partition means and into stationary TEM transmission lines for coupling electromagnetic energy to external electromagnetic wave devices, said coupling probes being connected by nonconductive drive means for enabling said coupling probes to be rotated with said drive means determining the polarization of said electromagnetic energy by the rotational orientation of said coupling probes within said waveguides, said drive means comprising a drive rod oriented on a common axis with said coupling probes in each channel of said rotary polarizer, said stationary TEM transmission lines being contiguous with said conducting partition means and generally perpendicular to said drive rod.

2. The multiple channel microwave rotary polarizer of claim 1 wherein the electromagnetic energy is coupled to at least one of said transmission lines through a coupling device comprising a coaxial transmission line, said coaxial transmission line having an outer conductor and an inner conductor, said inner conductor including a stationary section and a rotatable section, said rotatable section comprising said second end of a respective one of said coupling probes and being partially contained within a hollow tube section of said outer conductor, and said rotatable section being connected to and rotationally fixed with respect to said nonconductive drive means.

3. The multiple channel microwave rotary polarizer of claim 1 wherein the electromagnetic energy is coupled to at least one of said transmission lines by a coupling device comprising a stationary transmission line section and a rotatable transmission line section coupled to one another through approximately a quarter wave choke section formed on a first end of said stationary transmission line inner conductor and comprising a hollow choke outer conductor and a choke inner conductor formed by said second end of said coupling probe and having one end of said hollow choke outer conductor forming an open circuit with said choke inner conductor wherein said choke inner conductor is supported by a dielectric support means to said choke outer conductor, and wherein said choke section is formed at an angle with respect to the continuation of said stationary transmission line inner conductor of which it is a part, and wherein said supported choke inner conductor is capable of rotation within said supporting choke outer conductor and wherein said support means extends through said outer conductor of said stationary transmission line section line system to form a drive for driving said choke inner conductor by external drive means.

4. The multiple channel microwave rotary polarizer of claim 1 wherein said stationary transmission lines are connected to signal processing circuits for means of conditioning the said electromagnetic waves coupled by said coupling probes.

5. The multiple channel microwave rotary polarizer of claim 1 wherein said stationary transmission lines extend into waveguides and form electrical mode couplings.

6. The multiple channel microwave rotary polarizer of claim 1 wherein the stationary transmission line for at least one channel is comprised of a microstrip transmission line, said microstrip transmission line having a strip conductor and a ground plane, at least a portion of said strip conductor formed as a hollow tube section with said second end of a respective one of said coupling probes being rotatably mounted in said hollow tube section within a nonconductive rod and fixed to said rod for determining the rotational position of said coupling probe by rotation of said rod by external means.

7. A multiple channel microwave rotary polarizer, each channel comprising a transmission line having a stationary section and a continuously rotatable section, said rotatable section having electrical continuity to said stationary section and each said rotatable section being connected to and rotationally fixed with respect to a dielectric rod passing outside said transmission line to external rotational means for rotating said rod and said transmission line rotatable section for establishing the rotational position of said rod and said transmission line rotatable section by said external rotational means, and said transmission line rotatable section passing through a hole in the conducting partition means of a waveguide, each stationary section being coupled to each rotatable section by a coupling in each channel comprised of a stationary transmission line section and a continuously rotatable transmission line section coupled to one another through approximately a quarter wave choke section formed on an end of an inner conductor of said stationary transmission line, said choke section comprising a hollow choke outer conductor and a choke inner conductor, one end of said hollow choke outer conductor forming an open circuit with said choke inner conductor, said choke inner conductor being supported by said dielectric rod to said choke outer conductor, said choke section being formed at an angle with respect to a continuation of said stationary transmission line conductor of which it is a part, said supported choke inner conductor being capable of rotation within said supporting choke outer conductor and wherein said dielectric rod extends through an outer conductor of said transmission line to form a bi-directional drive between said choke inner conductor and said external rotational means, said choke inner conductor for each channel being located on a common axis with said dielectric rod.

8. The multiple channel microwave rotary polarizer of claim 7 wherein the stationary transmission lines are connected to signal processing circuits for means of conditioning the electromagnetic waves coupled by the coupling probes.

9. The multiple channel microwave rotary polarizer of claim 7 wherein said stationary transmission lines extend into waveguides and form electrical mode couplings.

10. The multiple channel microwave rotary polarizer of claim 7 wherein the stationary transmission line for at least one channel is comprised of a microstrip transmission line, said microstrip transmission line having a strip conductor and a ground plane, at least a portion of said strip conductor being formed as a hollow tube section with said second end of a respective one of said coupling probes being rotatably mounted in said hollow tube section within a nonconductive rod and fixed to said rod for determining the rotational position of said coupling probe by rotation of said rod by external means.

* * * * *